US005451272A

United States Patent [19]

Uemura et al.

[11] Patent Number: 5,451,272

[45] Date of Patent: Sep. 19, 1995

[54] SILVER-OXIDE ELECTRIC CONTACT MATERIAL FOR USE IN SWITCHES FOR HIGH CURRENT

[75] Inventors: Yuzo Uemura; Shigeo Shibuya; Manabu Aoki, all of Susono, Japan

[73] Assignee: Mitsubishi Materials Corporation, Tokyo, Japan

[21] Appl. No.: 224,430

[22] Filed: Apr. 8, 1994

Related U.S. Application Data

[63] Continuation-in-part of Ser. No. 955,658, Oct. 2, 1992, abandoned, which is a continuation-in-part of Ser. No. 830,176, Jan. 31, 1992, abandoned.

[30] Foreign Application Priority Data

Apr. 12, 1991 [JP] Japan ..... 3-122024
Sep. 27, 1991 [JP] Japan ..... 3-276790

[51] Int. Cl.[6] ..... C22C 5/06

[52] U.S. Cl. ..... 148/431; 420/501; 200/266; 148/430

[58] Field of Search ..... 148/431, 281, 288, 430, 148/284; 200/266; 420/501, 502; 75/234

[56] References Cited

U.S. PATENT DOCUMENTS 3,933,485 1/1976 Shibata .
4,131,458 12/1978 Satoh et al. .
4,462,841 7/1984 Miyakawa et al. ..... 148/431
5,207,842 5/1993 Guerlet et al. .

FOREIGN PATENT DOCUMENTS 0252492 1/1988 European Pat. Off. .
0388259 9/1990 European Pat. Off. .
0508055 10/1992 European Pat. Off. .
1342227 9/1993 France .
58-144445 8/1963 Japan .
58-144446 8/1963 Japan .
52-33067 3/1977 Japan .
55-4825 2/1980 Japan .
58-110639 7/1983 Japan .
4-314837 11/1992 Japan .
5-86426 4/1993 Japan .

OTHER PUBLICATIONS

CA95(18): 160853V 1980.
Bohm et al, Influence of Small Alloying Additions on the Internal Oxidation and the Switching Behavior of AgSnIn-Alloys, 1980, pp. 905-914.
Electrical Contacts-1989, Proceedings of the 35th Meeting of the IEEE Holm Conference on Electrical Contacts, Sep. 20, 1989 Chicago, U.S., pp. 69-78, Lambert et al, "A New Doped Silver Tin Oxide Material with Improved Electrical Behaviour".

*Primary Examiner*—Deborah Yee
*Attorney, Agent, or Firm*—Frishauf, Holtz, Goodman, Langer & Chick

[57] ABSTRACT

A silver-oxide material for electric contacts of high-current switches, having excellent deposition resistance and consumption resistance. The material is formed by subjecting to an internal oxidation treatment an Ag alloy consisting essentially, by weight %, of:

Sn: 5.1-8.5%;

In: 1.7-3.2%;

Te: 0.1-0.6%; and

Ag and inevitable impurities: the balance. If required, at least one of the following elements may be added:

Ni: 0.05-0.2%; and

Cd: 0.3-0.8%.

8 Claims, No Drawings

SILVER-OXIDE ELECTRIC CONTACT MATERIAL FOR USE IN SWITCHES FOR HIGH CURRENT

CROSS-REFERENCE TO RELATED CASES

This application is a continuation-in-part application of application Ser. No. 07/955,658, filed Oct. 2, 1992, now abandoned, the entire text of which is incorporated herein by reference, which is a continuation-in-part of application Ser. No. 07/830,176, filed Jan. 31, 1992, now abandoned.

BACKGROUND OF THE INVENTION

1. Field of the Invention

This invention relates to a silver-oxide material for electric contacts for use in switches applied to various types of electrical and electronic apparatus, and more particularly to a silver-oxide electric contact material for use in switches for high current of 5 A or more.

2. Prior Art

Conventionally, a great many electrical contact materials for use in switches for high current have been proposed and used in various electrical and electronic apparatus. Among widely used electric contact materials for switches for high current, there is known, for example, by Japanese Patent Publication (Kokoku) No. 55-4825, a silver-oxide electric contact material which is formed by subjecting an Ag alloy consisting essentially of, by weight % (hereinafter the percentage is represented by weight %), 5 to 10% Sn, and 1 to 6% In, and, if required, 0.01 to 0.5% Ni, and the balance of Ag and inevitable impurities, to an internal oxidation treatment in which the Ag alloy is −0.5% Ni, and the balance of Ag and inevitable impurities, to an internal oxidation treatment in which the Ag alloy is soaked in an oxidizing atmosphere at a temperature of 650° to 750° C. for a predetermined time period.

Further, there is also known from Japanese Provisional Patent Publication (Kokai) No. 58-110639, a silver-oxide sliding contact material (sliding current-carrying material) which is formed by subjecting an Ag alloy consisting essentially of 0.5–15% at least one element selected from the group consisting of Cd, Cu, In, Mn, Sb, Sn and Zn, and, if required, 0.1–3% at least one element selected from the group consisting of As, Ba, Mo, Pb, Se and Te, and/or 0.01–0.5% at least one element selected from the group consisting of Fe, Ni and Co, and the balance of Ag and inevitable impurities, to an internal oxidation treatment under the same conditions as mentioned above.

In recent years, there has been made a remarkable progress in the development of electrical and electronic apparatus having improved performance and prolonged service lives. Accordingly, there is an increasing demand for electric contact materials for high-current switches use in these electrical and electronic apparatus, which have improved deposition resistance and consumption resistance.

In actuality, however, most of the conventional electric contact materials for high-current switches inclusive of the former known electric contact material mentioned above do not have sufficient deposition resistance and consumption resistance to satisfy requirements imposed by recently developed electrical and electronic apparatus.

Further, the latter known sliding contact material mentioned above is used for contact chips of a commutator of a small-sized electric motor, i.e. as current-carrying chips for carrying a current as small as 100 mA or less. As a result, if the latter known sliding contact material is used as contacts of a high current switch which switches a high current of 5 A or more, it will result in a significant amount of deposition such that the contacts cannot be practically used.

SUMMARY OF THE INVENTION

It is, therefore, the object of the invention to provide silver-oxide materials for electric contacts of high-current switches, which have excellent deposition resistance and consumption resistance and hence prolonged service lives.

To attain the above object, the present invention provides a silver-oxide material for electric contacts of high-current switches, having excellent deposition resistance and consumption resistance, the material being formed by subjecting to an internal oxidation treatment an Ag alloy consisting essentially of:

Sn: 5.1–8.5%;

In: 1.7–3.2%;

Te: 0.1–0.6%; and

Ag and inevitable impurities: the balance.

If required, at least one of the following elements may be added:

Ni: 0.05–0.2%; and

Cd: 0.3–0.8%.

The above and other objects, features, and advantages of the invention will become more apparent from the following detailed description.

DETAILED DESCRIPTION

Under the above stated circumstances, the present inventors have made many studies in order to obtain silver-oxide electric contact materials for high-current switches, having improved deposition resistance and consumption resistance, and reached the following finding:

A silver-oxide material for electric contacts of high-current switches, which is formed by subjecting an Ag alloy consisting essentially of:

Sn: 5.1–8.5%;

In: 1.7–3.2%;

Te: 0.1–0.6%;

and, if required, at least one of the following elements (a) and (b):

(a) Ni: 0.05–0.2%; and (b) Cd: 0.3–0.8%; and

Ag and inevitable impurities: the balance, to an internal oxidation treatment under ordinary conditions as mentioned above, i.e.:

atmosphere: oxidizing atmosphere;

oxidizing temperature: 650°–750° C.; and soaking time: 8–26 hr, has far more excellent deposition resistance and consumption resistance as compared with the aforementioned known silver-oxide electric contact material, when used as a material for high-current switches.

The present invention is based upon the above finding, and the silver-oxide electric contact material for high-current switches according to the invention has the aforementioned chemical compositions.

The reasons for specifying as above the contents of the component elements of the Ag alloy before being subjected to the internal oxidation treatment will now be described:

(a) Sn:

The Sn component forms oxides in the alloy, which act to enhance the deposition resistance. However, if the Sn content is less than 5.1%, desired excellent deposition resistance cannot be obtained, whereas if the Sn content exceeds 8.5%, the contact resistance of the resulting electric contacts is apt to increase, and further the silver-oxide material will have lowered workability in manufacturing electric contacts therefrom. Therefore, the Sn content should be limited to a range of 5.1 to 8.5%.

(b) In:

The In component acts to promote oxidation of the Sn component, and also the In component itself forms oxides which act to enhance the deposition resistance and consumption resistance. However, if the In content is less than 1.7%, the above actions cannot bring about remarkably improved results, whereas if the In content exceeds 3.2%, the resulting electric contact material is apt to have lowered deposition resistance. Therefore, the In content should be limited to a range of 1.7 to 3.2%.

(C) Te:

The Te component forms oxides which can easily sublime upon generation of an arc due to closure and opening of the electric contacts to thereby further enhance the deposition resistance and consumption resistance. However, if the Te content is less than 0.1%, the above action cannot bring about remarkably improved results, whereas if the Te content is in excess of 0.6%, the resulting contact material is apt to have lowered workability. Therefore, the Te content should be limited to a range of 0.1 to 0.6%.

(d) Ni:

Ni may be added if required. The Ni component dissolves in the matrix to finely divide the oxides and the Ag grains to thereby improve the deposition resistance. However, if the Ni content is below 0.05% the above action cannot bring about remarkably improved results, whereas if the Ni content exceeds 0.2% the workability is apt to lower. Therefore, the Ni content should be limited to a range of 0.05% to 0.2%

(e) Cd:

Cd may be added if required, since the Cd component cooperates with the Te component to further enhance the deposition resistance. However, if the Cd content is less than 0.3%, desired excellent deposition resistance cannot be obtained, whereas in excess of 0.8%, the consumption resistance is apt to lower. Thus, the Cd content should be limited to a range of 0.3 to 0.8%.

Thus, a silver-oxide material for electric contacts of high-current switches, having excellent deposition resistance and consumption resistance, consists essentially of:

Sn: 5.1–8.5%;

In: 1.7–3.2%;

Te: 0.1–0.6%;

and, if required, at least one of the following elements (a) and (b):

(a) Ni: 0.05–0.2%; and (b) Cd: 0.3–0.8%; and

Ag and inevitable impurities: the balance.

Next, examples of the silver-oxide electric contact material for high-current switches according to the invention will be described.

EXAMPLE 1

Ag alloys having chemical compositions shown in Tables 1 to 3 were smelted in an ordinary type high-frequency smelting furnace and cast under conventional ordinary casting conditions into ingots. The ingots were each hot extruded into a plate having a thickness of 5 mm. The plate was then hot rolled, followed by being cold rolled into a sheet having a width of 30 mm and a thickness of 0.6 mm. The sheet was cut or sliced in its longitudinal direction into a strip having a width of 2 mm. The strip was subjected to an internal oxidation treatment in an oxygen atmosphere at a temperature of 700° C. and for a soaking time of 24 hours. The internally oxidized strips were put together and compacted into a billet having a diameter of 70 mm. The billet was extruded into a diameter of 7 mm, followed by being subjected to wire drawing into a wire having a diameter of 2 mm. Finally, the wire was formed, by a header machine, into rivets having a head diameter of 4 mm, a head height of 1 mm, a leg diameter of 2 mm, and a leg length of 2 mm. The obtained rivets were used as specimens of the silver-oxide electric contact material according to the present invention (hereinafter referred to as "the present invention contact materials Nos. 1 to 10") and specimens of conventional silver-oxide electric contact materials (hereinafter referred to as "the conventional contact materials Nos. 1 to 16").

Then, electrical tests were conducted on the present invention contact materials Nos. 1 to 10 and the conventional contact materials Nos. 1 to 16 by repeatedly alternately applying and breaking a high current of 30 A to the materials by the use of an electric contact testing machine according to ASTM under the following conditions to examine the number of

TABLE 1

| SPECIMEN | CHEMICAL COMPOSITION OF Ag ALLOY (WT %) Sn | In | Te | Ni | Ag + IMPURITIES | NUMBER OF TIMES OF DEPOSITION | CONSUMPTION AMOUNT ($\times 10^{-5}$ g) |
|---|---|---|---|---|---|---|---|
| PRESENT INVENTION CONTACT MATERIALS | | | | | | | |
| 1 | 5.16 | 2.08 | 0.28 | — | BAL. | 3 | 29 |
| 2 | 6.48 | 2.23 | 0.32 | — | BAL. | 2 | 27 |
| 3 | 8.46 | 2.16 | 0.30 | — | BAL. | 0 | 24 |
| 4 | 6.42 | 1.74 | 0.26 | — | BAL. | 2 | 28 |
| 5 | 6.53 | 3.18 | 0.32 | — | BAL. | 0 | 23 |
| 6 | 6.44 | 2.34 | 0.11 | — | BAL. | 3 | 30 |
| 7 | 6.52 | 2.16 | 0.57 | — | BAL. | 0 | 25 |
| 8 | 6.49 | 2.20 | 0.31 | 0.053 | BAL. | 0 | 26 |
| 9 | 6.46 | 2.28 | 0.33 | 0.102 | BAL. | 1 | 26 |
| 10 | 6.50 | 2.48 | 0.27 | 0.193 | BAL. | 0 | 25 |

TABLE 2

| SPECIMEN | CHEMICAL COMPOSITION OF Ag ALLOY (WT %) Sn | In | Te | Ni | Ag + IMPURITIES | NUMBER OF TIMES OF DEPOSITION | CONSUMPTION AMOUNT ($\times 10^{-5}$ g) |
|---|---|---|---|---|---|---|---|
| CONVENTIONAL CONTACT MATERIALS | | | | | | | |
| 1 | 5.14 | 2.21 | — | — | BAL. | 65 | 40 |
| 2 | 6.49 | 2.25 | — | — | BAL. | 34 | 48 |
| 3 | 8.39 | 2.24 | — | — | BAL. | 24 | 56 |
| 4 | 6.48 | 1.73 | — | — | BAL. | 38 | 48 |
| 5 | 6.49 | 3.16 | — | — | BAL. | 40 | 51 |
| 6 | 6.52 | 2.25 | — | 0.052 | BAL. | 28 | 43 |
| 7 | 6.51 | 2.21 | — | 0.108 | BAL. | 23 | 45 |
| 8 | 6.47 | 2.28 | — | 0.195 | BAL. | 21 | 49 |

TABLE 3

| SPECIMEN | CHEMICAL COMPOSITION OF Ag ALLOY (WT %) Sn | In | Te | Ni | Ag + IMPURITIES | NUMBER OF TIMES OF DEPOSITION | CONSUMPTION AMOUNT ($\times 10^{-5}$ g) |
|---|---|---|---|---|---|---|---|
| CONVENTIONAL CONTACT MATERIALS | | | | | | | |
| 9 | 6.47 | — | — | — | BAL. | 412 | 172 |
| 10 | — | 2.27 | — | — | BAL. | SEVERE DEPOSITION CAUSED INCAPABILITY OF SWITCHING OPERATION AFTER 36TH SWITCHING | |
| 11 | 6.39 | — | 0.31 | — | | 365 | 162 |
| 12 | — | 2.15 | 0.33 | — | BAL. | SEVERE DEPOSITION CAUSED INCAPABILITY OF SWITCHING OPERATION AFTER 46TH SWITCHING | |
| 13 | 6.52 | — | — | 0.105 | BAL. | 403 | 168 |
| 14 | — | 2.23 | — | 0.094 | BAL. | SEVERE DEPOSITION CAUSED INCAPABILITY OF SWITCHING OPERATION AFTER 39TH SWITCHING | |
| 15 | — | 2.18 | 0.30 | 0.110 | BAL. | SEVERE DEPOSITION CAUSED INCAPABILITY OF SWITCHING OPERATION AFTER 55TH SWITCHING | |
| 16 | 6.45 | — | 0.29 | 0.092 | BAL. | 330 | 156 |

times of deposition and the amount of consumption in order to evaluate the deposition resistance and the consumption resistance:

DC Voltage: 14 V;
Making Current: 150 A;
Breaking Current: 30 A;
Switching Time: ON for 1 sec—OFF for 9 sec;
Contact Force: 80 g;
Opening Force: 80 g;
Number of Times of Switching: 10,000

The results of the tests are shown in Tables 1 to 3.

EXAMPLE 2

Rivets were formed from Ag alloys having chemical compositions shown in Tables 4 and 5 under the same conditions as in Example 1 described above to obtain present invention contact materials Nos. 11–21 and conventional contact materials Nos. 17–22.

Then, electrical tests were conducted on the present invention contact materials Nos. 11–21 and the conventional contact materials Nos. 17–22 by repeatedly alternately applying and breaking a high current of 20 A to the materials by the use of an electric contact testing machine according to ASTM under the following conditions to examine the number of times of deposition and the amount of consumption in order to evaluate the deposition resistance and the consumption resistance:

DC Voltage: 24 V;
Making Current: 100 A;
Breaking Current: 20 A;
Switching Time: ON for 1 sec—OFF for 9 sec;

TABLE 4

| SPECIMEN | CHEMICAL COMPOSITION OF Ag ALLOY (WT %) Sn | In | Te | Cd | Ni | Ag + IMPURITIES | NUMBER OF TIMES OF DEPOSITION | CONSUMPTION AMOUNT ($\times 10^{-5}$ g) |
|---|---|---|---|---|---|---|---|---|
| PRESENT INVENTION CONTACT MATERIALS | | | | | | | | |
| 11 | 5.14 | 2.11 | 0.31 | 0.48 | — | BAL. | 5 | 28 |
| 12 | 6.53 | 2.23 | 0.34 | 0.32 | — | BAL. | 2 | 25 |
| 13 | 8.43 | 2.24 | 0.30 | 0.52 | — | BAL. | 0 | 22 |
| 14 | 6.48 | 1.73 | 0.29 | 0.50 | — | BAL. | 4 | 29 |
| 15 | 6.53 | 3.14 | 0.31 | 0.47 | — | BAL. | 3 | 30 |
| 16 | 6.47 | 2.16 | 0.12 | 0.49 | — | BAL. | 7 | 33 |
| 17 | 6.50 | 2.24 | 0.58 | 0.51 | — | BAL. | 0 | 21 |
| 18 | 6.54 | 2.19 | 0.32 | 0.79 | — | BAL. | 3 | 34 |
| 19 | 6.51 | 2.21 | 0.31 | 0.50 | 0.052 | BAL. | 1 | 25 |
| 20 | 6.50 | 2.24 | 0.30 | 0.49 | 0.101 | BAL. | 0 | 23 |

TABLE 4-continued

| SPECIMEN | CHEMICAL COMPOSITION OF Ag ALLOY (WT %) Sn | In | Te | Cd | Ni | Ag + IMPURITIES | NUMBER OF TIMES OF DEPOSITION | CONSUMPTION AMOUNT ($\times 10^{-5}$ g) |
|---|---|---|---|---|---|---|---|---|
| 21 | 6.53 | 2.24 | 0.31 | 0.52 | 0.195 | BAL. | 0 | 22 |

TABLE 5

| SPECIMEN | CHEMICAL COMPOSITION OF Ag ALLOY (WT %) Sn | In | Te | Cd | Ni | Ag + IMPURITIES | NUMBER OF TIMES OF DEPOSITION | CONSUMPTION AMOUNT ($\times 10^{-5}$ g) |
|---|---|---|---|---|---|---|---|---|
| CONVENTIONAL CONTACT MATERIALS | | | | | | | | |
| 17 | 6.42 | 2.25 | — | — | — | BAL. | 42 | 48 |
| 18 | 6.51 | 2.20 | — | — | 0.103 | BAL. | 39 | 39 |
| 19 | — | — | — | 0.64 | — | BAL. | SEVERE DEPOSITION CAUSED INCAPABILITY OF SWITCHING OPERATION AFTER 2ND SWITCHING | |
| 20 | — | — | 0.32 | 0.58 | — | BAL. | SEVERE DEPOSITION CAUSED INCAPABILITY OF SWITCHING OPERATION AFTER 5TH SWITCHING | |
| 21 | — | — | — | 0.59 | 0.110 | BAL. | SEVERE DEPOSITION CAUSED INCAPABILITY OF SWITCHING OPERATION AFTER 4TH SWITCHING | |
| 22 | — | — | 0.32 | 0.56 | 0.094 | BAL. | SEVERE DEPOSITION CAUSED INCAPABILITY OF SWITCHING OPERATION AFTER 7TH SWITCHING | |

Contact Force: 100 g;
Opening Force: 100 g;
Number of Times of Switching: 5,000

The results of the tests are shown in Tables 4 and 5.

It will be learned from Tables 1 to 5 that the present invention contact materials Nos. 1 to 21 all show far more excellent deposition resistance and consumption resistance in switching or repeated alternate applying and breaking of high current than the conventional contact materials Nos. 1 to 22.

Since silver-oxide electric contact materials according to the present invention thus possess excellent deposition resistance and consumption resistance in repeated alternate applying and breaking of high current, if they are actually used as materials of high-current switches in various electrical and electronic apparatus, they will greatly contribute to improving the performance of the electrical and electronic apparatus as well as to prolongation of the service lives thereof.

What is claimed is:

1. A silver-oxide material for electric contacts of high-current switches, having excellent deposition resistance and consumption resistance, said material being formed by subjecting to an internal oxidation treatment an Ag alloy consisting essentially, by weight %, of:
Sn: 5.1–8.5%;
In: 1.7–3.2%;
Te: 0.1–0.6%; and
Ag and inevitable impurities: the balance.

2. A silver-oxide material for electric contacts of high-current switches, having excellent deposition resistance and consumption resistance, said material being formed by subjecting to an internal oxidation treatment an Ag alloy consisting essentially, by weight %, of:
Sn: 5.1–8.5%;
In: 1.7–3.2%;
Te: 0.1–0.6%;
Ni: 0.05–0.2%; and
Ag and inevitable impurities: the balance.

3. A silver-oxide material for electric contacts of high-current switches, having excellent deposition resistance and consumption resistance, said material being formed by subjecting to an internal oxidation treatment an Ag alloy consisting essentially, by weight %, of:
Sn: 5.1–8.5%;
In: 1.7–3.2%;
Te: 0.1–0.6%;
Cd: 0.3–0.8%; and
Ag and inevitable impurities: the balance.

4. A silver-oxide material for electric contacts of high-current switches, having excellent deposition resistance and consumption resistance, said material being formed by subjecting to an internal oxidation treatment an Ag alloy consisting essentially, by weight %, of:
Sn: 5.1–8.5%;
In: 1.7–3.2%;
Te: 0.1–0.6%;
Cd: 0.3–0.8%;
Ni: 0.05–0.2%; and
Ag and inevitable impurities: the balance.

5. The silver-oxide material for electric contacts of high-current switches as claimed in claim 1, wherein said internal oxidation treatment is carried out under the following conditions:
atmosphere: oxidizing atmosphere;
oxidizing temperature: 650°–750° C.; and
soaking time: 8–26 hr.

6. The silver-oxide material for electric contacts of high-current switches as claimed in claim 2, wherein said internal oxidation treatment is carried out under the following conditions:
atmosphere: oxidizing atmosphere;
oxidizing temperature: 650°–750° C.; and
soaking time: 8–26 hr.

7. The silver-oxide material for electric contacts of high-current switches as claimed in claim 3, wherein said internal oxidation treatment is carried out under the following conditions:

atmosphere: oxidizing atmosphere;
oxidizing temperature: 650°–750° C.; and
soaking time: 8–26 hr.

8. The silver-oxide material for electric contacts of high-current switches as claimed in claim 4, wherein said internal oxidation treatment is carried out under the following conditions:

atmosphere: oxidizing atmosphere;
oxidizing temperature: 650°–750° C.; and
soaking time: 8–26 hr.

* * * * *